US009920576B2

(12) United States Patent
Spencer

(10) Patent No.: US 9,920,576 B2
(45) Date of Patent: Mar. 20, 2018

(54) CUTTING ELEMENTS FOR EARTH-BORING TOOLS, EARTH-BORING TOOLS INCLUDING SUCH CUTTING ELEMENTS, AND RELATED METHODS

(71) Applicant: Baker Hughes Incorporated, Houston, TX (US)

(72) Inventor: Reed W. Spencer, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 145 days.

(21) Appl. No.: 14/873,366

(22) Filed: Oct. 2, 2015

(65) Prior Publication Data

US 2017/0096859 A1 Apr. 6, 2017

(51) Int. Cl.

| | |
|---|---|
| ***E21B 10/46*** | (2006.01) |
| ***E21B 10/43*** | (2006.01) |
| ***B24D 3/00*** | (2006.01) |
| ***E21B 10/26*** | (2006.01) |
| ***E21B 10/567*** | (2006.01) |

(52) U.S. Cl.

CPC ..... *E21B 10/43* (2013.01); *B24D 3/008* (2013.01); *E21B 10/26* (2013.01); *E21B 10/46* (2013.01); *E21B 10/5673* (2013.01)

(58) Field of Classification Search

CPC ..... E21B 10/46; E21B 10/56

See application file for complete search history.

(56) References Cited

U.S. PATENT DOCUMENTS 5,535,838 A * 7/1996 Keshavan ..... C23C 4/06 175/374
5,890,552 A 4/1999 Scott et al.
5,944,129 A 8/1999 Jensen (Continued)

FOREIGN PATENT DOCUMENTS

WO 2004111381 A1 12/2004

OTHER PUBLICATIONS

Patel, U.S. Appl. No. 14/480,293 entitled, Multi-Chamfer Cutting Elements Having a Shaped Cutting Face, Earth-Boring Tools Including Such Cutting Elements, and Related Methods, filed Sep. 8, 2014.

(Continued)

*Primary Examiner* — Frederick L Lagman
(74) *Attorney, Agent, or Firm* — TraskBritt

(57) ABSTRACT

A cutting element for an earth-boring tool includes a substrate and a volume of superabrasive material disposed on a substrate. The volume of superabrasive material has an exposed outer surface with a non-planar geometry. The cutting element is configured to be located and oriented on an earth-boring tool so as to remove subterranean earth formation material by compressing and fracturing or plastically deforming the formation material with at least a portion of the exposed outer surface of the volume of superabrasive material during use of the earth-boring tool in an earth-boring operation. The exposed outer surface of the volume of superabrasive material includes a first area having a first average surface finish roughness and a second area having a second average surface finish roughness greater than the first average surface finish roughness. Earth-boring tools carrying such cutting elements and methods of forming such earth-boring tools are also disclosed.

20 Claims, 9 Drawing Sheets

(56) References Cited

U.S. PATENT DOCUMENTS

| | | | | |
|---|---|---|---|---|
| 6,145,608 | A | 11/2000 | Lund et al. | |
| 6,332,503 | B1 | 12/2001 | Pessier et al. | |
| 6,766,870 | B2 * | 7/2004 | Overstreet | E21B 10/50 175/374 |
| 8,505,634 | B2 | 8/2013 | Lyons et al. | |
| 8,684,112 | B2 | 4/2014 | DiGiovanni et al. | |
| 8,727,042 | B2 * | 5/2014 | DiGiovanni | B24D 99/005 175/426 |
| 8,794,356 | B2 | 8/2014 | Lyons et al. | |
| 8,919,462 | B2 | 12/2014 | DiGiovanni et al. | |
| 8,991,525 | B2 | 3/2015 | Bilen et al. | |
| 9,103,174 | B2 | 8/2015 | DiGiovanni | |
| 2008/0035387 | A1 | 2/2008 | Hall et al. | |
| 2009/0114628 | A1 | 5/2009 | DiGiovanni | |
| 2009/0321146 | A1 | 12/2009 | Dick et al. | |
| 2010/0051349 | A1 | 3/2010 | Ballard et al. | |
| 2012/0205162 | A1 | 8/2012 | Patel et al. | |
| 2013/0068534 | A1 | 3/2013 | DiGiovanni | |
| 2013/0068538 | A1 | 3/2013 | DiGiovanni et al. | |
| 2013/0292188 | A1 | 11/2013 | Bilen et al. | |
| 2014/0196969 | A1 | 7/2014 | Jaffarullah et al. | |
| 2014/0246253 | A1 | 9/2014 | Patel et al. | |
| 2015/0190904 | A1 | 7/2015 | Bilen et al. | |

OTHER PUBLICATIONS

International Search Report for International Application No. PCT. US2016/054174 dated Jan. 6, 2017, 3 pages.

International Written Opinion for International Application No. PCT.US2016/054174 dated Jan. 6, 2017, 10 pages.

* cited by examiner

CUTTING ELEMENTS FOR EARTH-BORING TOOLS, EARTH-BORING TOOLS INCLUDING SUCH CUTTING ELEMENTS, AND RELATED METHODS

TECHNICAL FIELD

Embodiments of the present disclosure relate to earth-boring tools, cutting elements for such earth-boring tools, and related methods.

BACKGROUND

Wellbores are formed in subterranean earth formations for various purposes including, for example, extraction of oil and gas from the subterranean formation and extraction of geothermal heat from the subterranean formation. Wellbores may be formed in a subterranean formation using a drill bit such as, for example, an earth-boring rotary drill bit. Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed-cutters and rolling-cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the outermost diameter of the drill bit.

The drill bit is coupled, either directly or indirectly, to an end of what is referred to in the art as a "drill string," which comprises a series of elongated tubular segments connected end-to-end and extends into the wellbore from the surface of the formation. Often, various tools and components, including the drill bit, may be coupled together at the distal end of the drill string at the bottom of the wellbore being drilled. This assembly of tools and components is referred to in the art as a "bottom-hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

It is known to use what are referred to in the art as a "reamer" devices (also referred to as "hole opening devices" or "hole openers") in conjunction with a drill bit as part of a bottom-hole assembly when drilling a wellbore in a subterranean formation. In such a configuration, the drill bit operates as a "pilot" bit to form a pilot bore in the subterranean formation. As the drill bit and bottom-hole assembly advances into the formation, the reamer device follows the drill bit through the pilot bore and enlarges the diameter of, or "reams," the pilot bore.

The bodies of earth-boring tools, such as drill bits and reamers, are often provided with fluid courses, such as "junk slots," to allow drilling mud (which may include drilling fluid and formation cuttings generated by the tools that are entrained within the fluid) to pass upwardly around the bodies of the tools into the annular shaped space within the wellbore above the tools outside the drill string.

When drilling a wellbore, the formation cuttings may adhere to, or "ball" on, the surface of the drill bit. The cuttings may accumulate on the cutting elements and the surfaces of the drill bit or other tool, and may collect in any void, gap or recess created between the various structural components of the bit. This phenomenon is particularly enhanced in formations that fail plastically, such as in certain shales, mudstones, siltstones, limestones and other relatively ductile formations. The cuttings from such formations may become mechanically packed in the aforementioned voids, gaps or recesses on the exterior of the drill bit. In other cases, such as when drilling certain shale formations, the adhesion between formation cuttings and a surface of a drill bit or other tool may be at least partially based on atomic attractive forces and/or bonds therebetween.

BRIEF SUMMARY

This summary does not identify key features or essential features of the claimed subject matter, nor does it limit the scope of the claimed subject matter in any way.

In some embodiments, an earth-boring tool includes a body and at least one cutting element carried by the body. The at least one cutting element comprises a volume of superabrasive material disposed on a substrate. The volume of superabrasive material has an exposed outer surface with a non-planar geometry. The at least one cutting element is located and oriented on the body so as to remove subterranean earth formation material by compressing and fracturing or plastically deforming the formation material with at least a portion of the exposed outer surface of the volume of superabrasive material during use of the earth-boring tool in an earth-boring operation. The exposed outer surface of the volume of superabrasive material includes a first area having a first average surface finish roughness less than 500 nanometers and a second area having a second average surface finish roughness greater than 500 nanometers.

In other embodiments, a method of forming an earth-boring tool includes obtaining a first cutting element comprising a volume of superabrasive material disposed on a substrate. The volume of superabrasive material has an exposed outer surface with a non-planar geometry. The first cutting element is configured to be located and oriented on the earth-boring tool so as to remove subterranean earth formation material by compressing and fracturing or plastically deforming the formation material with at least a portion of the exposed outer surface of the volume of superabrasive material during use of the earth-boring tool in an earth-boring operation. The exposed outer surface of the volume of superabrasive material includes a first area having a first average surface finish roughness and a second area having a second average surface finish roughness greater than the first average surface finish roughness. The method includes attaching the first cutting element to a face of the earth-boring tool and attaching a second cutting element to the face of the earth-boring tool at a location adjacent the first cutting element. The second cutting element is configured to remove subterranean earth formation material by shearing the formation material from uncut formation material.

In additional embodiments, a cutting element for an earth-boring tool includes a substrate and a volume of superabrasive material disposed on a substrate. The volume of superabrasive material has an exposed outer surface with a non-planar geometry. The cutting element is configured to be located and oriented on an earth-boring tool so as to remove subterranean earth formation material by compressing and fracturing or plastically deforming the formation material with at least a portion of the exposed outer surface of the volume of superabrasive material during use of the earth-boring tool in an earth-boring operation. The exposed outer surface of the volume of superabrasive material includes a first area having a first average surface finish roughness and a second area having a second average surface finish roughness greater than the first average surface finish roughness.

BRIEF DESCRIPTION OF THE DRAWINGS

While the specification concludes with claims particularly pointing out and distinctly claiming what are regarded as embodiments of the present disclosure, various features and advantages of this disclosure may be more readily ascertained from the following description of example embodiments of the disclosure provided with reference to the accompanying drawings.

DETAILED DESCRIPTION

The illustrations presented herein are not actual views of any particular earth-boring tool, drill bit, reamer device, cutting element, or component of such a tool, bit or reamer, but are merely idealized representations which are employed to describe embodiments of the present disclosure.

As used herein, the term "earth-boring tool" means and includes any tool used to remove subterranean earth formation material and form or enlarge a bore (e.g., a wellbore) through the formation by way of the removal of the formation material.

As used herein, the term "cutting element" means and includes any element of an earth-boring tool that is used to cut, shear, fracture, plastically deform, or otherwise disintegrate formation material when the earth-boring tool is used to form or enlarge a bore in the formation.

As used herein, the term "shearing" means and includes causing a portion of subterranean earth formation to move along a plane of contact with a cutting element.

As used herein, the term "shearing cutting element" means and includes any cutting element of an earth-boring tool that is configured to be located and oriented on the earth-boring tool for cutting formation material at least primarily by a shearing mechanism when the earth-boring tool is used to form or enlarge a bore in the formation.

As used herein, the term "gouging cutting element" means and includes any cutting element of an earth-boring tool that is configured to be located and oriented on the earth-boring tool for engaging formation material in a non-shearing manner. For example, a gouging cutting element may remove formation material primarily by at least one of a gouging, a penetrating and a crushing mechanism. However, a gouging cutting element may be configured primarily not to remove formation material but to provide bearing surfaces on an earth-boring tool or to act as a depth-of-cut limiting feature for shearing cutting elements. Generally, a dull gouging cutting element will exhibit more of a bearing behavior when engaging subterranean formation material while a relatively sharper gouging cutting element will exhibit more of a cutting behavior when engaging subterranean formation material, although it is to be appreciated that each may exhibit some degree of bearing behavior and some degree of cutting behavior.

As used herein, the term "polish," and any derivative thereof, when used to describe a condition of a surface of a volume of superabrasive material or a substrate of a cutting element, means and includes any method and/or process used to provide a planar surface having an average surface finish roughness less than about 2.0 microinches (μin.) (about 50.8 nanometers (nm)) root mean square (RMS) (all surface finishes referenced herein being RMS) or a non-planar surface having an average surface finish roughness less than about 25.0 μin. (about 635 nm).

Figure 1:
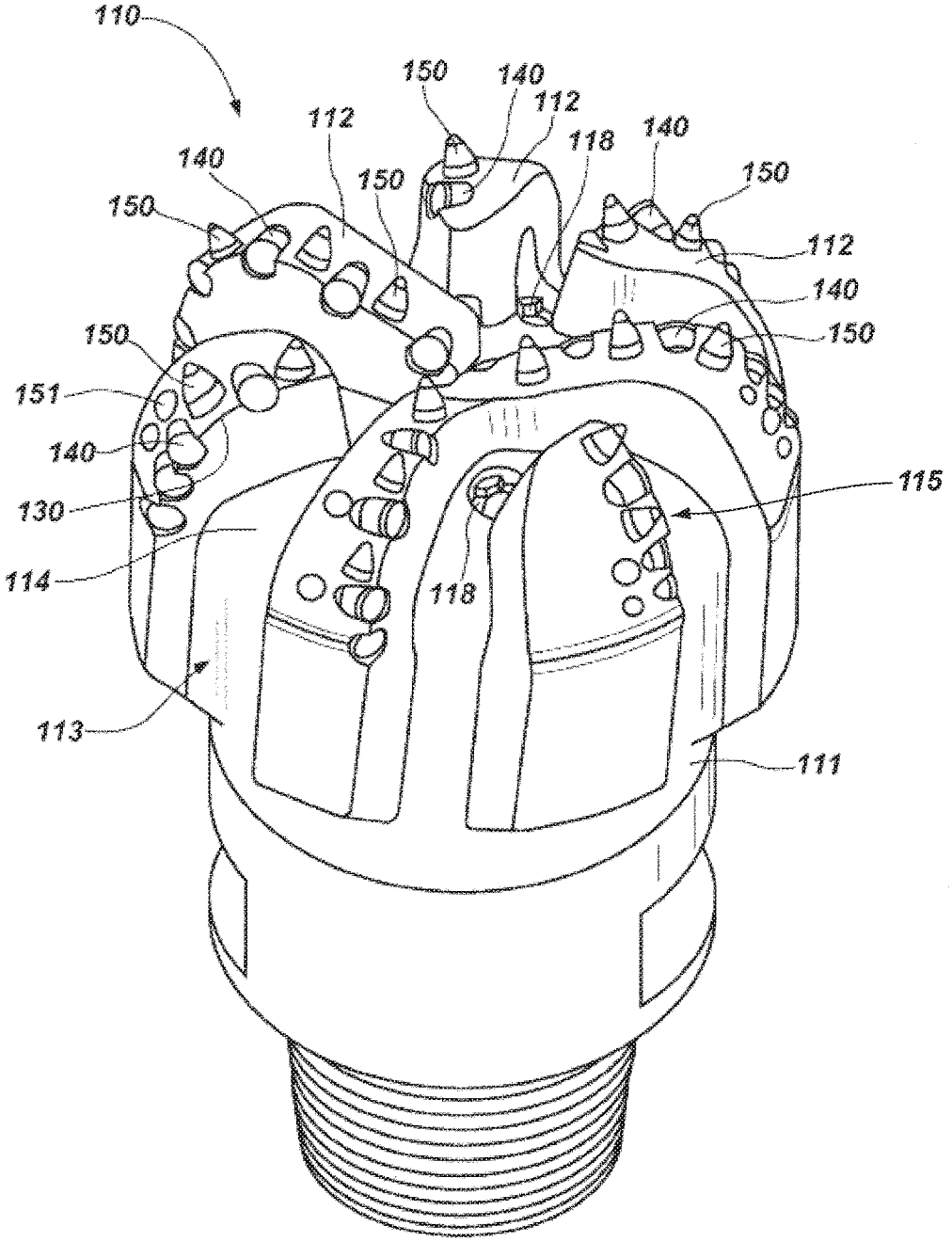
FIG. 1 illustrates a perspective view of an earth-boring tool comprising a fixed-cutter rotary drill bit, which includes cutting elements as described herein attached to a body of the drill bit, according to an embodiment of the present disclosure.

FIG. 1 illustrates an embodiment of an earth-boring tool of the present disclosure. As shown, the earth-boring tool may be a fixed-cutter drill bit 110 having a bit body 111 that includes a plurality of blades 112 projecting outwardly from a face 115 of the bit body 111 and separated from one another by fluid courses 114. Portions of the fluid courses 114 that extend along radial sides (i.e., the "gage" areas) of the drill bit 110 are often referred to in the art as "junk slots." The bit body 111 may further include a generally cylindrical internal fluid plenum, and fluid passageways that extend through the bit body 111 to the fluid courses 114 on the face 115 of the bit body 111. Nozzles 118 may be secured within the fluid courses 114 on the face 115 of the bit body 111 between blades 112 for controlling the hydraulics of the drill bit 110 during a drilling operation. A plurality of cutting elements may be mounted to each of the blades 112 proximate rotationally leading edges 130 of the blades 112. The cutting elements may include a combination of shearing cutting elements 140 and gouging cutting elements 150, as discussed in further detail below. Wear knots 151 may optionally be provided on the blades 112 at locations rotationally behind the cutting elements.

In further embodiments (not shown), two, three or more rows of gouging cutting elements 150 may be provided on one or more blades 112. It is to be appreciated that any combination of shearing cutting elements 140 and gouging cutting elements 150 may be carried by any of the blades 112 of the drill bit 110. It is also to be appreciated that, while FIG. 1 illustrates the drill bit 110 carrying a combination of shearing cutting elements 140 and gouging cutting elements 150, earth-boring tools carrying gouging cutting elements 150 and no shearing cutting elements 140 are also within the scope of the present disclosure.

Figure 15:
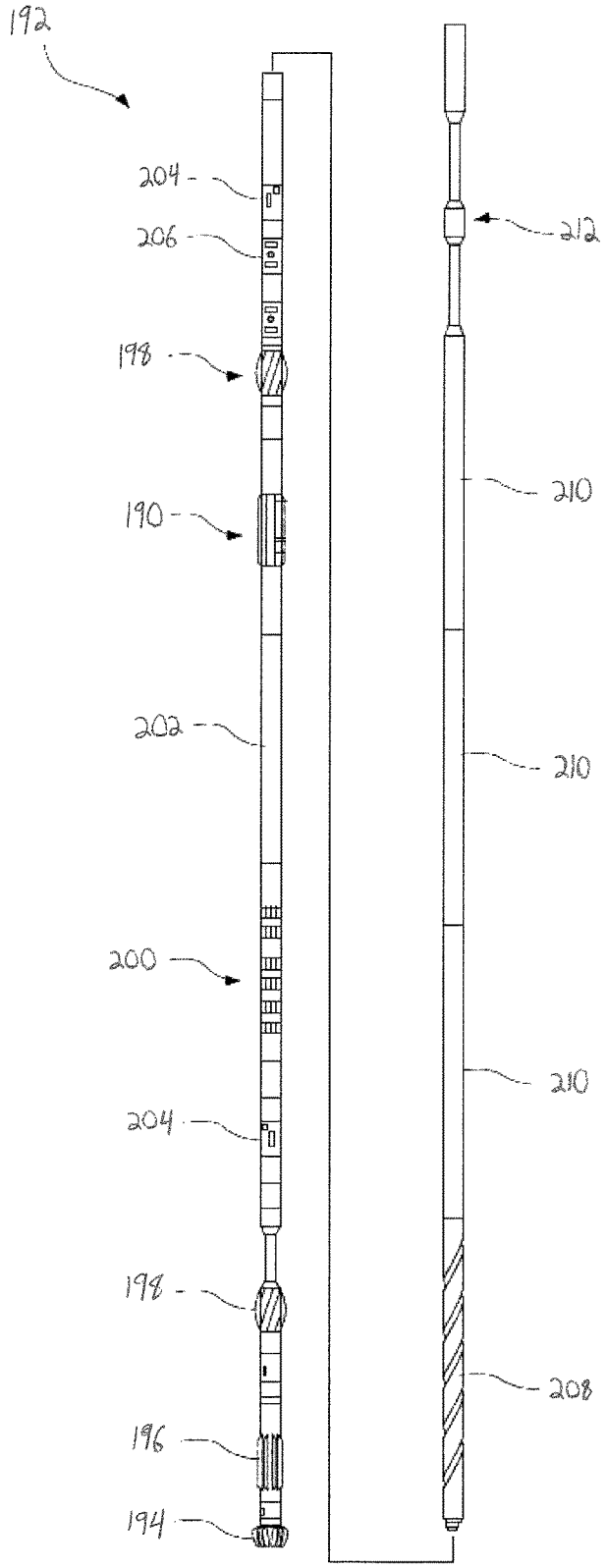
FIG. 15 is a schematic illustration of a bottom-hole assembly including a pilot drill bit and a reamer, according to an embodiment of the present disclosure.

During a drilling operation, the drill bit 110 may be coupled to a drill string (FIG. 15). As the drill bit 110 is rotated within the wellbore, drilling fluid may be pumped down the drill string, through the internal fluid plenum and fluid passageways within the bit body 111 and out from the drill bit 110 through the nozzles 118. Formation cuttings generated by the cutting elements 140, 150 of the drill bit 110 may be carried with the drilling fluid across the face 115 through the fluid courses 114, around the drill bit 110 through junk slots 113, and back up the wellbore through the annular space within the wellbore outside the drill string.

The shearing cutting elements 140 may each include a volume of superabrasive material disposed on a substrate, as known in the art. The volume of superabrasive material may comprise a sintered polycrystalline diamond (PCD) material and may have a cutting face configured to shear formation material from uncut formation material during an earth-boring operation. The cutting face may be substantially planar, although shearing cutting elements 140 may have cutting faces with shaped features and non-planar geometries, as disclosed in U.S. Pat. No. 8,684,112, issued on Apr. 1, 2014 to DiGiovanni et al.; U.S. Pat. No. 8,919,462, issued on Dec. 30, 2014 to DiGiovanni et al.; U.S. Pat. No. 9,103,174, issued Aug. 11, 2015 to DiGiovanni; U.S. Patent Publication Nos. 2013/0068534 A1, published Mar. 21, 2013 in the name of DiGiovanni et al.; 2013/0068538 A1, published Mar. 21, 2013 in the name of DiGiovanni et al.; and 2014/0246253 A1, published Sep. 4, 2014 in the name of Patel et al.; and U.S. application Ser. No. 14/480,293, filed Sep. 8, 2014 in the name of Patel et al., the entire disclosure of each of which is incorporated herein by this reference. The substrate may be formed from and include ceramic-metal composite materials (which are often referred to as "cermet" materials). The substrate may include a cemented carbide material, such as a cemented tungsten carbide material, in which tungsten carbide particles are cemented together in a metallic binder material. The metallic binder material may include, for example, cobalt, nickel, iron, or alloys and mixtures thereof. The volume of superabrasive material may be formed on the substrate, or the volume of superabrasive material and the substrate may be separately formed and subsequently attached together.

As the shearing cutting elements 140 cut formation material, the formation cuttings generally are deflected over and across the cutting faces of the shearing cutting elements 140 and are generally directed by drilling fluid emanating from the nozzles 118 into a junk slot 113. Each shearing cutting element 140 may be mounted on a blade 112 at a positive rake angle, a negative rake angle, or a neutral rake angle relative to a formation to be cut. The shearing cutting elements 140 also may be mounted with a side rake angle relative to a formation to be cut.

Figure 2:
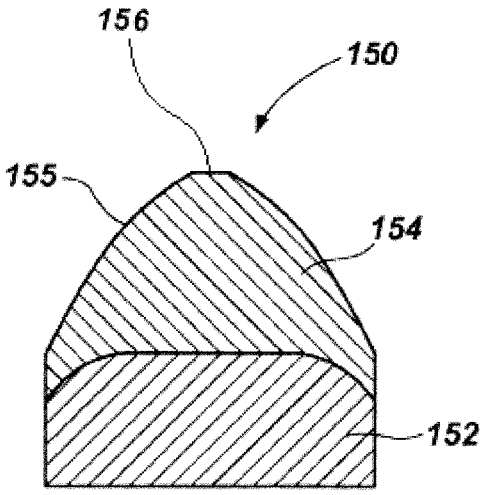
FIG. 2 illustrates a cross-sectional view of a dome-shaped gouging cutting element that may be carried by an earth-boring tool, such as the drill bit of FIG. 1.

FIG. 2 is a cross-sectional view of an example gouging cutting element 150 for use with an earth-boring tool, such as the drill bit 110 of FIG. 1. The gouging cutting element 150 may include a substrate 152 having a volume of superabrasive material 154 disposed thereon. The volume of superabrasive material 154 may comprise synthetic diamond, natural diamond, a combination of synthetic diamond and natural diamond, polycrystalline diamond (PCD), or other superabrasive materials known in the art. The volume of superabrasive material 154 may have a non-planar exposed outer face 155 which may include an ovoid or dome shape with an apex 156, as shown, although other shapes are within the scope of the present disclosure. The substrate 152 of the gouging cutting element 150 may be generally similar to the substrate of the shearing cutting elements 140. Furthermore, as with the shearing cutting elements, the volume of superabrasive material 154 of the gouging cutting element 150 may be formed on the substrate 152, or the volume of superabrasive material 154 and the substrate 152 may be separately formed and subsequently attached together. It is to be appreciated that, while the exposed outer surface 155 of the volume of superabrasive material 154 may be configured to exhibit more of a bearing behavior than a cutting behavior, the exposed outer surface 155 may in some instances be termed a "cutting face" if it is configured primarily to remove formation material.

Figure 3:
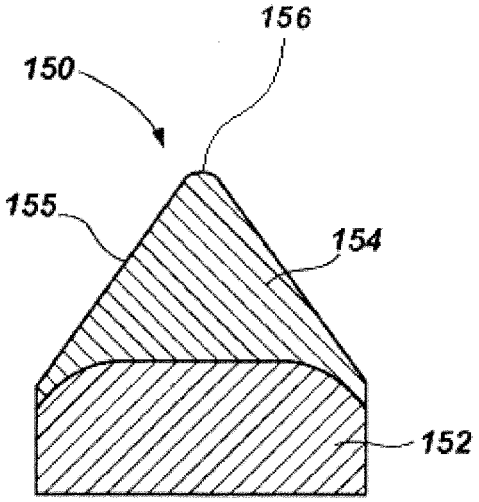
FIG. 3 illustrates a cross-sectional view of a cone-shaped gouging cutting element that may be carried by an earth-boring tool, such as the drill bit of FIG. 1.

FIG. 3 is a cross-sectional view of another configuration of the gouging cutting element 150 shown in FIG. 2. The gouging cutting element 150 of FIG. 3 may be substantially similar to the gouging cutting element 150 of FIG. 2, but may have an outer face 155 with a cone shape instead of a dome shape.

It is to be appreciated that many different types, shapes and configurations of gouging cutting elements may be employed with earth-boring tools of the present disclosure. By way of non-limiting example, the gouging cutting elements 150 of the present disclosure may be configured as disclosed in U.S. Pat. No. 5,890,552, issued Apr. 6, 1999 to Scott et al., and U.S. Pat. No. 6,332,503, issued Dec. 25, 2001 to Pessier et al., and U.S. Patent Application Publication No. 2008/0035387 A1, published Feb. 14, 2008 to Hall et al., the entire disclosure of each of which is incorporated herein by this reference. Furthermore, gouging cutting elements having different shapes may be employed on the same earth-boring tool and/or on the same blade or within the same region of the earth-boring tool. The gouging cutting elements 150 may be mounted on an earth-boring tool at a positive rake angle, a negative rake angle, a negligible rake angle, or a side rake angle relative to the formation to be cut.

In some embodiments, the gouging cutting elements 150 may be configured to engage formation material at a point deeper in the formation than the shearing cutting elements 140. Stated differently, the gouging cutting elements 150 may have an over-exposure with respect to the formation in comparison to the shearing cutting elements 140. In other embodiments, the gouging cutting elements 150 may be arranged to have an exposure equivalent to an exposure of the shearing cutting elements 140. In yet other embodiments, the gouging cutting elements may be configured to have an under-exposure in comparison to the shearing cutting elements.

When used in combination with shearing cutting elements 140, gouging cutting elements 150 may be configured to provide a bearing function of the earth-boring tool and/or a depth-of-cut limiting function of the shearing cutting elements 140. As the outer face 155 of a gouging cutting element becomes more dull or blunt, the gouging cutting element 150 may generally provide more of a bearing function for the earth-boring tool and/or depth-of-cut limiting function for at least some of any shearing cutting elements 140 on the earth-boring tool (depending upon the relative placement and orientation of the gouging cutting elements 150 and the shearing cutting elements 140). Gouging cutting elements 150 may also serve to absorb impacts of the earth-boring tool against the formation. It is to be appreciated, however, that gouging cutting elements 150 may also be configured to cut and remove formation material, as described in more detail below.

Figure 4:
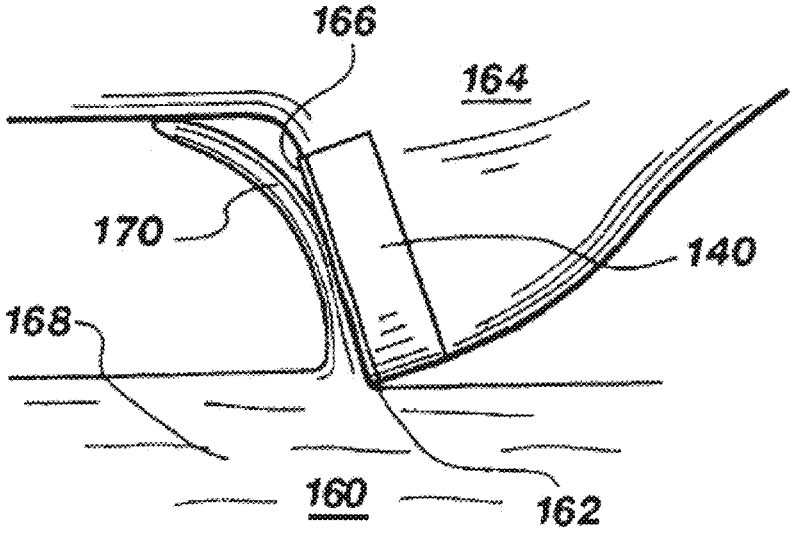
FIG. 4 (Prior Art)
FIG. 4 illustrates a side view of a prior art shearing cutting element engaging subterranean formation material.
Figure 5:
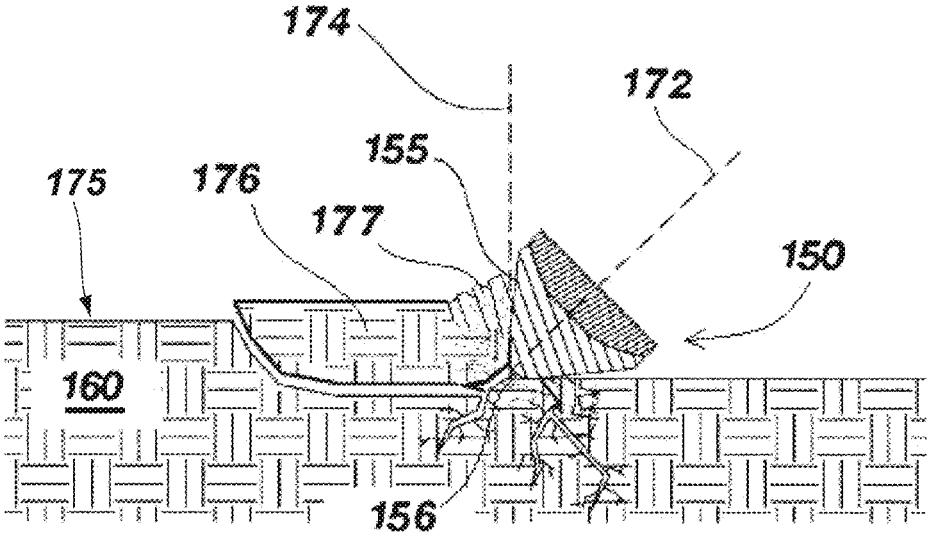
FIG. 5 (Prior Art)
FIG. 5 illustrates a side view of a prior art gouging cutting element engaging subterranean formation material.

Differences between the formation removal mechanisms of shearing cutting elements 140 and gouging cutting elements 150 are illustrated in FIGS. 4 and 5. Referring to FIG. 4, as a shearing cutting element 140 engages a subterranean formation 160, a cutting edge 162 of the shearing cutting element 140 may generally engage previously uncut subterranean formation material. The shearing cutting element 140 of FIG. 4 is shown oriented on an earth-boring tool 164 at a negative rake angle. When a cutting face 166 of the shearing cutting element 140 has been physically modified, such as, for example, by polishing, to have a surface roughness less than about 5.0 μin. (50.8 nm), the cutting edge 162 may be fully engaged with the previously uncut and undisturbed area 168 of the subterranean formation 160 and failure of the formation material may occur immediately adjacent the cutting edge 162. When a shearing cutting element 140 is pushed through uncut formation 168, the uncut formation 168 may fracture into granular pieces (not shown) which may then be substantially immediately compacted into the cutting face 166, due to the forward movement of the shearing cutting element 140 relative to the formation 160. In view of this, the granular pieces of fractured formation that impact the cutting face 166 may become compressed together, forming a cohesive structure 170 known generally in the art as a "chip." The cutting edge 162 of the polished cutting face 166 is able to cut or shear the chip 170 from the formation in an unimpeded manner. As shown, a formation chip 170 of substantially uniform thickness moves relatively freely from the point of contact or line of contact from the cutting edge 162 of the cutting face 166 upwardly across the cutting face 166 until it breaks off by contact with either the body or a chip-breaker of the earth-boring tool 164, or due to impact by drilling fluid emanating from a nozzle on the face of the earth-boring tool 164, or fluid coursing through a channel on the face of the earth-boring tool 164.

Referring now to FIG. 5, a gouging cutting element 150 removes formation material by a significantly different removal mechanism. In particular, the apex 156 of the gouging cutting element 150 may comprise a curvature that is sharp enough to penetrate the formation 160, but blunt enough to fail the formation 160 in compression ahead of itself. The gouging cutting element 150 of FIG. 5 is shown at a positive rake angle of about 45 degrees (45°) (measured from a longitudinal axis 172 of the gouging cutting element 150 and a line 174 perpendicular to an exposed surface 175 of the engaged formation 160). As the gouging cutting element 150 advances in the formation 160, the apex 156 fails the formation ahead of and peripherally to the sides of the gouging cutting element 150, creating fractures in the formation 160 that may propagate as the gouging cutting element 150 advances into the formation 160, eventually reaching the exposed surface 175 of the formation allowing large segments 176 to break from the formation 160. The gouging cutting element 150 may also compress and plastically deform formation material 160 ahead of and peripherally to the sides of the gouging cutting element 150, as shown at region 177. Segments 176 fractured from the formation 160 by the gouging cutting element 150 typically comprise a greater volume and different shape of formation material than the chips 170 removed by the shearing cutting element 140 (FIG. 4).

With continued reference to FIG. 5, as a gouging cutting element 150 cuts formation material, the formation cuttings generally are deflected over and around the non-planar outer face 155 of the gouging cutting element 150 in several directions, including to the lateral sides of the gouging cutting element 150 in directions generally parallel to the surface 175 of the formation 160 and laterally toward adjacent cutting elements. Thus, formation cuttings generated by a gouging cutting element 150 may be forced to pass between the gouging cutting element 150 and an immediately adjacent cutting element.

When the outer face 155 of a gouging cutting element 150 has been physically modified to have a surface roughness less than about 25 μin. (about 635 nm), the coefficient of friction of the outer face 155 is also reduced, resulting in less friction between the outer face 155 and formation cuttings moving across the outer face 155 as the gouging cutting element 150 engages formation material 160. As the friction forces on the outer face 155 are reduced, the torque required to cut formation material with the gouging cutting element 150 is also reduced. Lower friction forces on a relatively duller apex 156 allow the outer face 155 to have more of a bearing behavior and less of a cutting or removing behavior with respect to the formation material. As discussed in more detail below, selected areas of the outer face 155 of gouging cutting elements 150 may be modified to have a reduced surface finish roughness to provide the gouging cutting element 150, and the tool to which it is attached, with beneficial performance characteristics.

Referring again to FIG. 1, earth-boring tools, such as the drill bit 110 shown, may carry a combination of shearing cutting elements 140 and gouging cutting elements 150 in a manner benefiting from the different formation removal mechanisms thereof. For example, as shown in FIG. 1, at least some of the blades 112 may carry a row of alternating shearing cutting elements 140 and gouging cutting elements 150 proximate the rotationally leading edge 130 of the blades 112. In such embodiments, where a gouging cutting element 150 is located adjacent a shearing cutting element 140 in a row, formation cuttings generated by the gouging cutting element need not be squeezed or extruded through a relatively small space between immediately adjacent gouging cutting elements 150 (which, in relatively softer formation, may contribute to packing, or "balling," of formation cuttings around and/or between immediately adjacent gouging cutting elements 150), but instead formation cuttings generated by the gouging cutting elements 150 may be deflected laterally toward immediately adjacent shearing cutting elements 140, which may deflect and/or scoop cuttings away from the surface of the formation and into fluid courses 114 in the bit face 115. Additionally, the gouging cutting elements 150 may fracture and "soften" formation material ahead of at least portions of immediately adjacent shearing cutting elements 140, reducing shearing forces on the shearing cutting elements 140 and facilitating easier removal of formation material by the shearing cutting elements 140. Utilizing a combination of gouging cutting elements 150 and shearing cutting elements 140 on an earth-boring tool may enhance the removal of formation cuttings across the tool and provide a synergistic benefit of the combined, respective formation removal mechanisms to advantageously affect tool performance during an earth-boring operation. Such benefits may be tailored by manipulating a number of cutter parameters, as discussed in more detail below.

Additionally, the inclusion of gouging cutting elements 150 on an earth-boring tool, such as the drill bit 110 of FIG. 1, that also employs shearing cutting elements 140, may increase tool efficiency in interbedded formations that include both soft, plastically behaving formations and hard formations. Furthermore, such configurations may reduce torque and thus suppress undesirable torsional oscillations of the tool and thus increase dynamic stability of the tool (and the drill string) during earth-boring operations. Earth-boring tools that include a combination of gouging cutting elements 150 and shearing cutting elements 140 benefit from the ability of the gouging cutting elements to efficiently remove hard formation material through fracturing and gouging mechanisms, as well as from the ability of the shearing cutting elements 140 to efficiently remove relatively softer formation material through a shearing mechanism. Combining gouging cutting elements 150 and shearing cutting elements 140 on the same blade may result in removal of a more balanced amount of formation material per blade, relative to earth-boring tools that include only shearing cutting elements 140 on one or more blades 112 and only gouging cutting elements 150 on one or more other blades 112.

Additionally, selective configuration of gouging cutting elements 150 and shearing cutting elements 140 on an earth-boring tool may improve torque-related qualities of the tool. As previously described, gouging cutting elements 150 generally produce less torque than shearing cutting elements 140. Additionally, gouging cutting elements 150 on the tool may also effectively limit the depth at which the shearing cutting elements 140 on the tool are exposed to the formation (i.e., the gouging cutting elements 150 may serve a depth-of-cut (DOC) limiting function), which may reduce the amount of torque on the shearing cutting elements 140 and, by extension, the tool, during an earth-boring operation. Accordingly, gouging cutting elements 150 and shearing cutting elements 140 may be respectively configured on the earth-boring tool to achieve predetermined performance characteristics, including torque characteristics, in particular formation types and in consideration of various downhole parameters.

Figure 6:
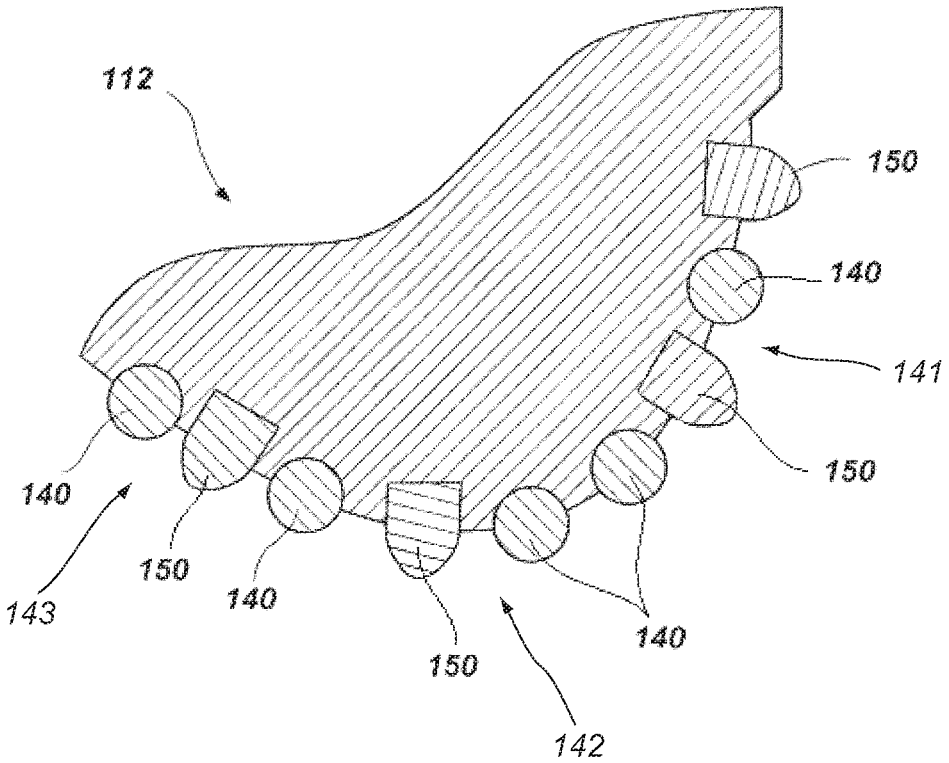
FIG. 6 illustrates a simplified cross-sectional view of a blade of the drill bit of FIG. 1 having one or more gouging cutting elements disposed thereon in combination with one or more shearing cutting elements in each of a cone region, a nose region and a shoulder region of a profile of the blade.

FIG. 6 illustrates a partial cross-sectional view of a blade 112 of the drill bit 110 of FIG. 1 carrying shearing cutting elements 140 and gouging cutting elements 150. The blade 112 may comprise a profile having a cone region 143, a nose region 142 and a shoulder region 141, as categorized in the art. As torque resulting from friction between cutting elements and formation material increases with increasing radial distance of the cutters from a longitudinal axis of the earth-boring tool, friction forces on radially outer cutting elements generally affect the torque required to remove formation material (i.e., torque-on-bit (TOB)) than friction forces on radially inner cutting elements. Accordingly, the blade 112 may carry one or more gouging cutting elements 150 in the radially outer regions of the blade profile, such as the nose region 142 and the shoulder region 141, to reduce torque. The blade 112 may also carry one or more gouging cutting elements 150 in the cone region 143. The blade 112 may also carry one or more shearing cutting elements 140 in any of the cone 143, nose 142, and shoulder regions 141 of the blade profile. It is to be appreciated that any combination of shearing cutting elements 140 and gouging cutting elements 150 located in any of the cone 143, nose 142, and shoulder regions 141 of a tool profile is within the scope of the present disclosure. Additionally, in some embodiments, each of the nose 142, cone 143, and shoulder regions 141 of the tool profile may comprise only gouging cutting elements 150.

Gouging cutting elements 150 may be employed on an earth-boring tool to manage torque- and/or friction-related phenomena, such as "stick-slip" and balling, by way of non-limiting example. Stick-slip of an earth-boring tool, and the tool vibrations caused thereby, is problematic and can be destructive to the tool, to the bottom-hole assembly, and even to the entire drill string. Stick-slip occurs as a result of energy accumulation at the face of the earth-boring tool as a function of the difference between static and dynamic (i.e., "sliding") friction between the tool and the formation. The tool may "stick," or momentarily fail to rotate, within the wellbore when the torque applied to the drill string fails to overcome static friction forces between the tool and the formation. During such stick periods, energy within the tool may accumulate as torque is applied to the drill string by one or more motors positioned in the bottom-hole assembly and/or at a surface of the well until the applied torque overcomes the static friction forces between the tool and the formation, causing the tool to suddenly "slip." Such slip may cause the drill string to spin violently and produce destructive vibrations within the tool, the bottom-hole assembly and/or the drill string, as well as causing loss of tool face, compromising direction of the wellbore. Accordingly, employing gouging cutting elements 150 in combination with shearing cutting elements 140 on an earth-boring tool may reduce friction forces between the tool and the formation, which may reduce the risk and occurrence of stick-slip during an earth-boring operation.

Figure 7:
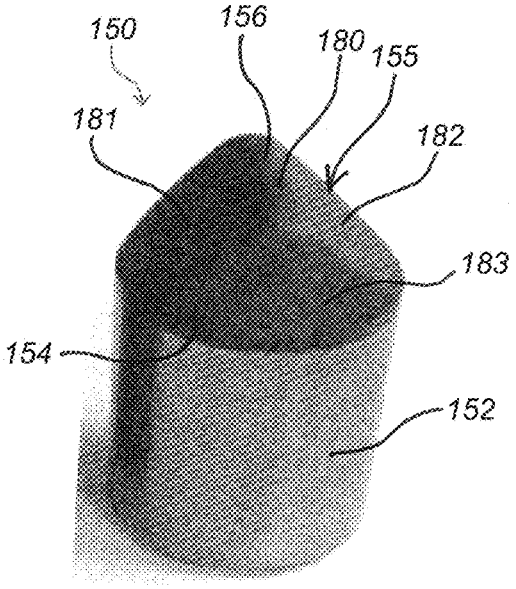
FIG. 7 illustrates a perspective view of a gouging cutting element that may be carried by an earth-boring tool, such as the drill bit of FIG. 1.

However, even when gouging cutting elements 150 are employed on an earth-boring tool, torque- and/or friction-related problems may result. The beneficial performance characteristics of an earth-boring tool carrying gouging cutting elements 150 may be significantly enhanced by modifying the outer face 155 of one or more of the gouging cutting elements 150. FIG. 7 illustrates a perspective view of an example gouging cutting element 150 comprising a volume of superabrasive material 154 disposed on a substrate 152. The outer face 155 of the volume of superabrasive material 154 may include a curved crest 180 positioned generally at the apex 156 of the outer face 155. A first generally planar flank 181 may be positioned on one side of the crest 180 and a second generally planar flank 182 may be positioned on an opposite side of the crest 180. A first generally rounded portion 183 may be located between the crest 180, the first generally planar flank 181 and the second generally planar flank 182. A second rounded portion 184 (visible in FIGS. 8 through 10) may be located between the crest 180 and the first and second generally planar flanks 181, 182 on a side of the crest 180 opposite the first generally rounded portion 183. Areas of the outer face 155 of the volume of superabrasive material 154 may be modified to have a reduced surface finish roughness relative to other areas of the outer face 155 in order to provide improved and/or tailored cutting performance. For example, providing areas of the outer face 155 with a reduced surface finish roughness lowers the coefficients of static and dynamic friction within the areas, reducing stick-slip vibrations on the earth-boring tool. Also, the reduced friction on the outer faces 155 of gouging cutting elements 150 improves tool face control in directional drilling operations.

Figure 8:
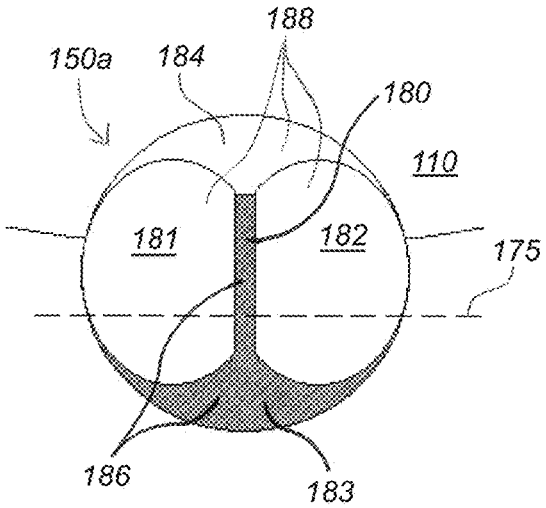
FIG. 8 illustrates a front view of a gouging cutting element (shaped similarly to the gouging cutting element of FIG. 7) having an outer face with a first area having a surface roughness less than a surface roughness of a second area of the outer face, according to an embodiment of the present disclosure.
Figure 9:
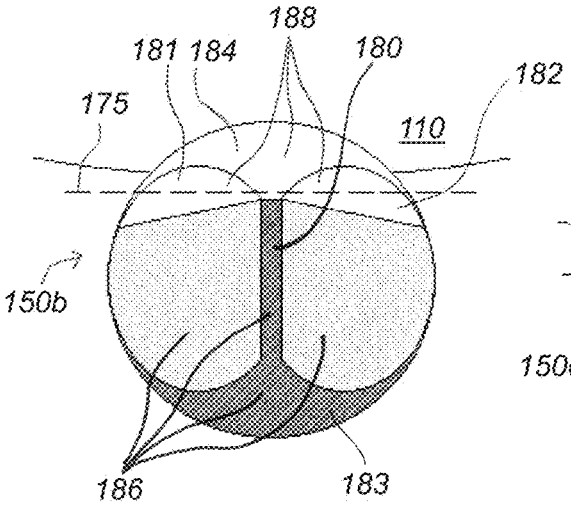
FIG. 9 illustrates a front view of a gouging cutting element (shaped similarly to the gouging cutting elements of FIGS. 7 and 8) having an outer face with a first area having a surface roughness less than a surface roughness of a second area, according to another embodiment of the present disclosure.
Figure 10:
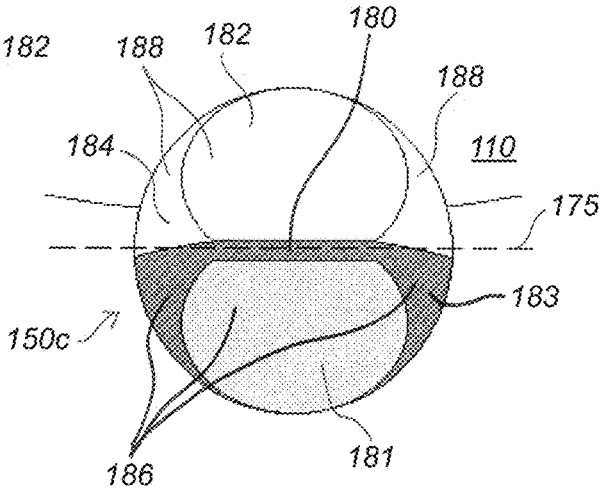
FIG. 10 illustrates a front view of a gouging cutting element (shaped similarly to the gouging cutting elements of FIGS. 7-9) having an outer face with a first area having a surface roughness less than a surface roughness of a second area, according to a further embodiment of the present disclosure.

FIGS. 8 through 10 each illustrate a front view of an outer face 155 of a gouging cutting element (shaped similarly to the gouging cutting element 150 of FIG. 7) as positioned on the drill bit 110 of FIG. 1 (or any other earth-boring tool) at various orientations relative to an exposed surface 175 of formation material 160 and at various depths-of-cut (DOC). Depending on factors pertaining to the position and orientation of the gouging cutting element as it will engage formation material (such as rake angle, depth-of-cut and angular orientation about the longitudinal axis of the cutter), selected areas of the outer face 155 may be modified to have a reduced surface finish roughness relative to other areas of the outer face 155. Stated differently, a first area 186 of the outer face 155 may be modified to have a first surface finish roughness and a second area 188 of the outer face 155 may have a second surface finish roughness greater than the first surface finish roughness.

In conventional, unpolished shearing cutting elements, the cutting faces may be lapped to a surface finish roughness in the range of about 20 μin.-40 μin. (508 nm-1016 nm). A surface finish roughness in the range of 20 μin.-40 μin. (508 nm-1016 nm) is relatively smooth to the touch and visually planar (if the polished surface is itself flat), but includes a number of surface anomalies and exhibits a degree of roughness, which is readily visible to one even under very low power magnification, such as a 10 times jeweler's loupe.

Polished surface finishes are also achievable for a non-planar outer face 155, or portions thereof, of a gouging cutting element 150, although non-planar surfaces of superabrasive material, such as PCD, are significantly more difficult to polish than planar surfaces thereof. An unpolished outer face 155 of a gouging cutting element 150 may have a surface finish roughness of about 40 μin.-50 μin. (1016 nm-1270 nm). The first area 186 of the outer face 155 may be modified to a polished surface finish roughness of about 25.0 μin. (about 635 nm) or less by any of the processes and techniques disclosed in U.S. Pat. No. 6,145,608, issued on Nov. 14, 2000 to Lund et al.; U.S. Pat. No. 8,991,525, issued Mar. 31, 2015 to Bilen et al.; and U.S. Patent Publication No. 2009/0114628 A1, published May 7, 2009 in the name of DiGiovanni, the entire disclosure of each of which is incorporated herein by this reference. For example, in some embodiments, the first area 186 of the outer face 155 may be polished to a surface finish roughness in the range of about 12 μin.-20 μin. (about 305 nm-508 nm). In further embodiments, the first area 186 of the outer face 155 may be polished to a surface finish roughness less than 12 μin. (305 nm), and even as low as 2 μin. (127 nm) or less, although such lower finishes may be significantly expensive to achieve.

In further embodiments, the first area 186 of the outer face 155 may be physically modified to have a polished surface finish roughness by applying thereon a conformal volume, or "coating," of diamond-like carbon (DLC) material having a surface roughness less than about 10 μin. (about 254 nm) according to any of the methods described in U.S. Patent Publication No. 2009/0321146A1, published Dec. 31, 2009 in the name of Dick et al., and U.S. Patent Publication No. 2012/0205162A1, published Aug. 16, 2012 in the name of Patel et al., the entire disclosure of each of which is incorporated herein by this reference. In yet additional embodiments, the first area 186 of the outer face 155 may be physically modified, such as by applying, or "growing," a conformal volume, or "coating," of synthetic diamond on the volume of superabrasive material 154 by a chemical vapor deposition (CVD) process. Synthetic diamond applied in such a manner may be referred to as "CVD diamond." A conformal volume of DLC material or CVD diamond may have a thickness in the range of about 197 μin. (about 5 micrometers (μm)) to about 0.0031 in. (about 80 μm). In other embodiments, the conformal volume of DLC material may have a thickness in the range of about 40 μin. (about 1.0 μm) to about 0.004 in. (about 102 μm).

In yet additional embodiments, a previously polished portion of the outer face 155 of a gouging cutting element 150 may be subsequently roughened to produce the second area 188 of the outer face 155 having a greater surface finish roughness than that of the first area 186. In such embodiments, the second area 188 of the outer face 155 may be roughed by a laser etching process, such as disclosed in any of U.S. Patent Publication No. 2009/0114628A1 and U.S. Pat. No. 8,991,525, each of which is incorporated by reference above. It is to be appreciated that other methods of roughing a polished area of an outer face 155 of a gouging cutting element 150 is within the scope of the present disclosure.

As shown in FIG. 8, a gouging cutting element **150*a* is positioned on the drill bit 110 such that the crest 180 is oriented generally perpendicular to the exposed surface 175 of the formation material 160 (as viewed in a plane perpendicular to the longitudinal axis 172 of the gouging cutting element 150*a*) and the outer face 155 engages the formation material 160 at a depth-of-cut less than a radius of the outer face 155. In such a configuration, the first area 186 (i.e., the area having a polished surface finish roughness) of the outer face 155 may include the crest 180 and the second generally rounded portion 184 (i.e., the generally rounded portion located within the depth-of-cut) of the outer face 155. In this manner, the portions of the outer face 155 impinging the most directly against the formation material 160 may have a polished surface finish roughness (and thus reduced coefficients of static and dynamic friction) to reduce friction forces between the outer face 155 and formation cuttings moving across the outer face 155 as the gouging cutting element engages formation material 160. In other embodiments, the first area 186 of the outer face 155 may include portions of the first and second generally planar flanks 181, 182, which may be more advantageous as the angle between the flanks 181, 182 becomes blunter and the flanks 181, 182 face more directly into the formation material 160. An advantage of selectively polishing portions of the outer face 155 on either lateral side of a point or region of the outer face that penetrates formation material is that the formation cuttings may be smaller, experience less lateral deflection, and may be directed more readily through the relatively small space between the gouging cutting element 150***a* and an immediately adjacent cutting element. Furthermore, only one of the flanks 181, 182 may be polished in order to provide advantageous cutting flow behavior across the flanks. For example, where one of the flanks 181, 182 is located closer to an adjacent cutting element than the other flank, only the flank 181, 182 that is closer to an adjacent cutting element may be polished to facilitate flow of cuttings between the polished flank and the adjacent cutting element. In other embodiments, the flank 181, 182 located more radially outward relative to the other flank may be polished to effectively "balance" the torque across the gouging cutting element 150*a*. As demonstrated herein, polishing selected surface of the outer face 155 provides numerous modes of tailoring performance of gouging cutting elements.

Referring now to FIG. 9, when a gouging cutting element 150*b* shaped similarly to that shown in FIG. 7 is positioned on the drill bit 110 generally similar to the manner shown in FIG. 8, with the exception that the outer face 155 engages the formation material 160 at a depth-of-cut greater than the radius of the outer face 155, the first area 186 of the outer face 155 may include the crest 180 and portions of the first and second generally planar flanks 181, 182 and a portion of the first generally rounded portion 183. As with FIG. 8, the first area 186 may optionally include other portions of the outer face 155 to impart the gouging cutting element 150*b* with predetermined performance characteristics.

Referring now to FIG. 10, when a gouging cutting element 150*c* shaped similarly to that shown in FIG. 7 is positioned on the drill bit 110 such that the crest 180 of the outer face 155 is oriented generally parallel with the exposed surface 175 of the formation material 160 and the outer face 155 engages the formation material 160 at a depth-of-cut about equivalent to the radius of the outer face 155, the first area 186 of the outer face 155 may include the crest 180 and portions of the first and second generally planar flanks 181, 182 and portions of the first and second rounded portions 183, 184 located within the depth-of-cut (i.e., located remote from the face 114 of the drill bit 110. As before, the first area 186 may include other portions of the outer face 155 to impart the gouging cutting element 150*c* with predetermined performance characteristics.

It is to be appreciated that the polishing patterns of the first areas 186 of the outer faces 155 depicted in FIGS. 8 through 10 represent only non-limiting examples of the virtually limitless variety of possible polishing patterns. The polishing patterns may be varied based on a large number of factors, including, but not limiting to, the shape and size of the outer face 155, the rake angle, the depth-of-cut, the formation material(s) expected to be encountered, the region of the tool profile (i.e., the cone, nose, shoulder and/or gage region) in which the cutter is to be mounted, and the configuration of the other cutters mounted on the tool. Any type of gouging cutting element 150 may have an outer face with polished surfaces. Additionally, other surfaces of gouging cutting elements 150 may also be polished, including lateral side surfaces of the volume of superabrasive material 154 or of the substrate 152. It is also to be appreciated that, as the costs relating to polishing non-planar surfaces is generally (and often significantly) more expensive than polishing planar surfaces faces, significant savings may be achieved by selectively polishing those surfaces of the gouging cutting element 155 calculated to provide the greatest reduction in friction forces during an earth-boring operation.

Figure 11:
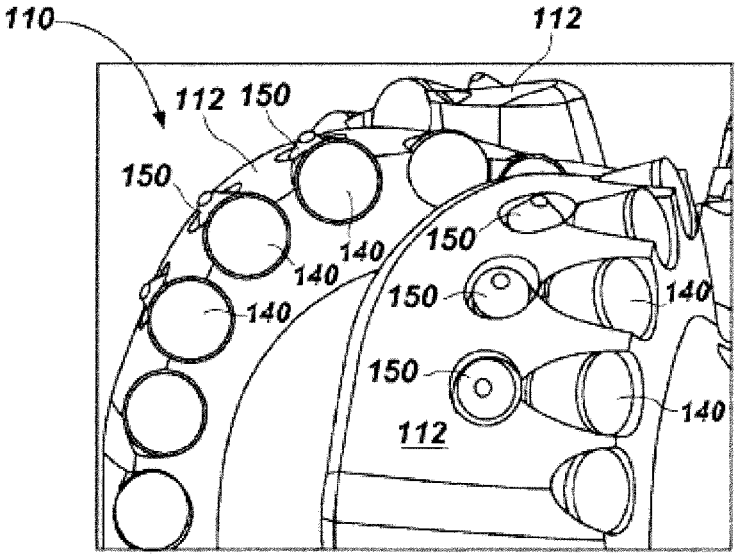
FIG. 11 illustrates a partial perspective view of a drill bit having blades carrying shearing cutting elements at a rotationally leading edge of each blade and gouging cutting elements on the blades in "backup" positions, according to an embodiment of the present disclosure.

Further examples of earth-boring tools carrying gouging cutting elements 150 with selected polished surfaces are shown in FIGS. 11 through 15. FIG. 11 illustrates a portion of a fixed-cutter drag bit 110 with shearing cutting elements 140 mounted along a rotationally leading surface 130 of each blade 112 and gouging cutting elements 150 mounted on the blades 112 rotationally behind the shearing cutting elements 140. In such embodiments, the gouging cutting elements may be considered "backup" cutting elements and may be located at the same longitudinal and radial position in the cutting element profile as a corresponding shearing cutting element, such that the backup gouging cutting element will at least substantially follow a path of a corresponding shearing cutting element (i.e., will gouge formation material substantially within a kerf cut in the formation material by a shearing cutting element). Selected areas of the outer faces 155 of the gouging cutting elements 150 may be polished to provide the bit 110 with predetermined performance characteristics. For example, selected areas of the gouging cutting elements 150 may be polished to increase the bearing behavior of the gouging cutting elements 150 and decrease formation removal by the gouging cutting elements 150. In other embodiments, radially outer areas (relative to bit 110) of the outer faces 155 of the gouging cutting elements 150 may be polished to reduce the torque on the drill bit 110. In further embodiments, one radial side (relative to the bit 110) of the outer faces 155 of the gouging cutting elements 150 may be polished to direct more formation cuttings to an opposite side of the outer face 155, similarly as disclosed in U.S. Pat. No. 8,991,525, incorporated by reference above. In yet additional embodiments, portions of the outer face 155 may be polished to reduce the likelihood of formation cuttings becoming trapped between an outer surface of the blade 112 and a surface of the formation, which may be particularly problematic when gouging cutting elements 150 are located in "backup" positions in relation to shearing cutting elements 140.

Figure 12:
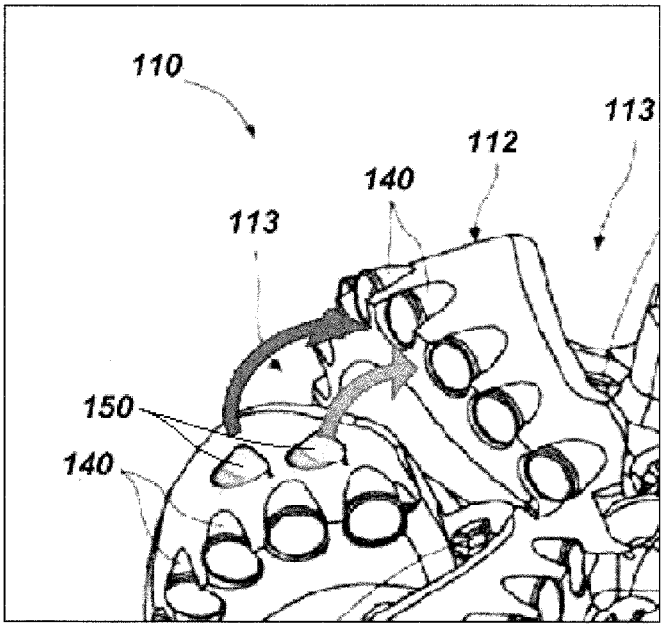
FIG. 12 illustrates a partial perspective view of a drill bit having a rotationally leading blade carrying gouging cutting elements and a rotationally trailing blade carrying shearing cutting elements positioned to directly follow the gouging cutting elements, according to an embodiment of the present disclosure.

In some of such embodiments, as shown in FIG. 12, the shearing cutting elements 140 on one blade 112 of the drill bit 110 may directly follow gouging cutting elements 150 mounted on a rotationally forward blade 112. In such embodiments, selected surfaces of the gouging cutting elements 150 may be polished to increase the fracturing of formation material ahead of the shearing cutting elements 140, effectively reducing shearing forces (and thus torque) on the shearing cutting elements 140.

Figure 13:
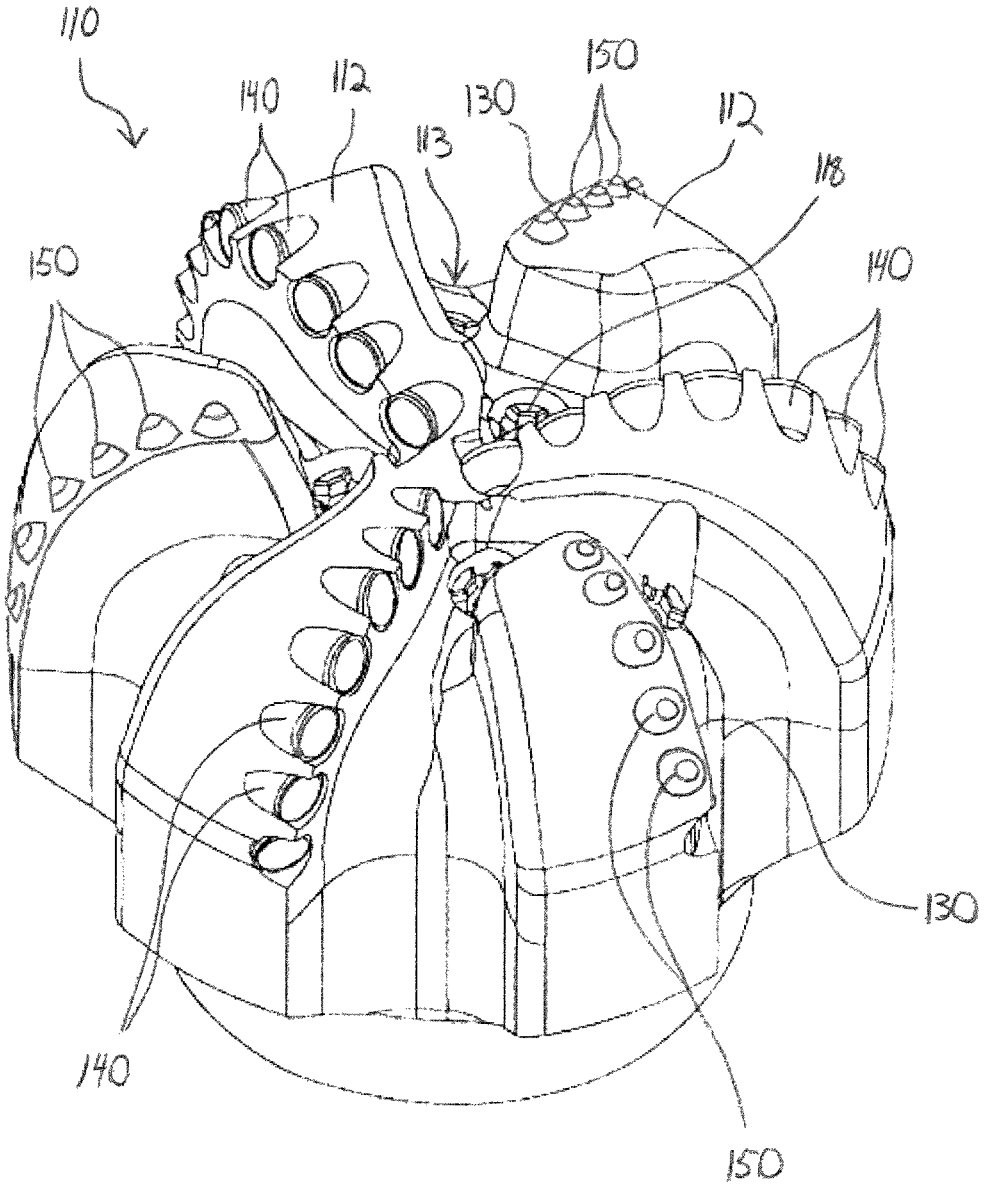
FIG. 13 illustrates a perspective view of a drill bit with a first set of blades carrying only shearing cutting elements and a second set of blades carrying only gouging cutting elements, in which the first set of blades and the second set of blades are in rotationally alternating positions, according to an embodiment of the present disclosure.

In other embodiments, as shown in FIG. 13, one or more blades 112 of an earth-boring tool 110 may carry a plurality of gouging cutting elements 150 mounted proximate a rotationally leading edge 130 of the blade 112 without any shearing cutting elements 140 mounted adjacent the gouging cutting elements 150 on the same blade 112. In such embodiments, selected surfaces of the gouging cutting elements 150 may be polished in any of the configurations previously described to provide the earth-boring tool with beneficial performance characteristics. By way of non-limiting example, at least some of the gouging cutting elements 150 may have their entire exposed outer face 155 polished. In other embodiments, at least some of the apexes 156 and surrounding regions of the outer faces 155 of at least some of the gouging cutting elements 150 may be polished. In further embodiments, at least some of the gouging cutting elements 150 may have a polished region on a radially inward or radially outward—"radially," in this instance, referencing a radial position of the tool face—portion of the outer face 155 of each such gouging cutting element 150 and an unpolished region on an opposite region of the outer face 155, wherein the differences is the coefficients of friction of the polished and unpolished regions may have an effect of steering formation cuttings to the unpolished side of the outer face 155, as described above. In this manner, selected portions of the outer faces 155 of at least some of the gouging cutting elements 150 may be polished to influence the flow direction of formation cuttings across the outer faces 155 of such gouging cutting elements 150 in favorable directions. The differences in the friction coefficients on the outer face 155 of such gouging cutting elements 150 may also result in formation cuttings that more easily break down or otherwise degrade after being cut.

Figure 14:
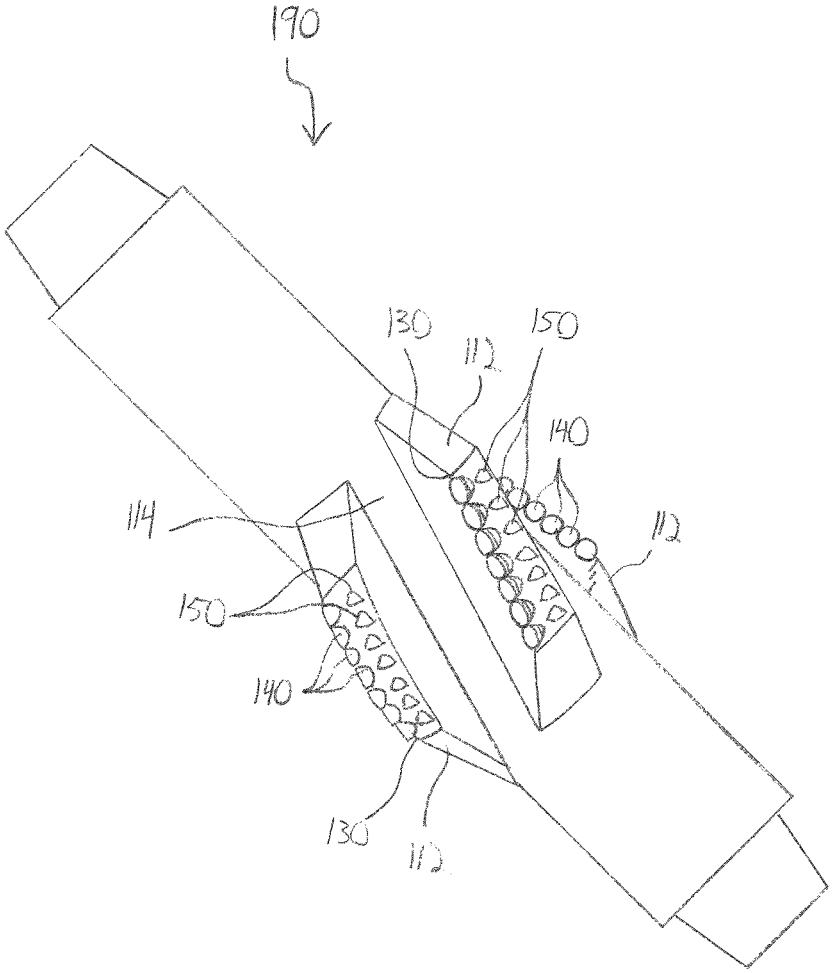
FIG. 14 illustrates a perspective view of a reamer tool having a plurality of blades each carrying a row of shearing cutting elements and a row of gouging cutting elements, according to an embodiment of the present disclosure.

FIG. 14 illustrates a reamer 190 with blades 112 on a body thereof carrying a plurality of shearing cutting elements 140 and a plurality of gouging cutting elements 150. The reamer 190 is shown having four blades 112 (three of which are visible) separated by fluid courses 114, each of the blades 112 carrying a row of shearing cutting elements 140 at a rotationally leading edge 130 of the blade 112 and a row of gouging cutting elements 150 in backup positions relative to the shearing cutting elements 140. At least some of the gouging cutting elements 150 may have outer faces 155 with selected areas polished, as previously disclosed herein, to achieve any of the beneficial performance characteristics described above. As the cutting elements carried by reamers are inherently positioned at a greater radius within the wellbore than cutting elements on a pilot drill bit, the reduction in friction forces on the gouging cutting elements 150 of the reamer 190 may have a heightened effect of reducing the amount of torque required to remove formation material with the reamer 190. It is to be appreciated that the reamer 190 may carry shearing cutting elements 140 and gouging cutting elements 150 relatively located according to any of the configurations disclosed previously herein.

FIG. 15 illustrates a bottom-hole assembly 192 used for reaming a well to a larger diameter than that initially drilled or for concurrently drilling and reaming a wellbore. The bottom-hole assembly 192, as illustrated, includes a pilot drill bit 194 and a reamer 190. The pilot drill bit 194 may be configured similarly to the drill bits 110 disclosed in relation to any of FIGS. 1 and 11 through 14. The bottom-hole assembly 192 optionally may include various other types of drilling tools such as, for example, one or more stabilizers 198, a steering unit 196, a measurement while drilling (MWD) tool 200, one or more bi-directional communications pulse modules (BCPMs) 202, one or more mechanics and dynamics tools 204 and one or more electronic devices 206. The bottom-hole assembly 192 may additionally include one or more drill collars 208, one or more segments of electrically communicative drill pipe 210, and one or more heavy weight drill pipe (HWDP) segments 212. The pilot drill bit 194 and the reamer 190 may each comprise gouging cutting elements 150 polished according to any of the embodiments previously described herein. The drill bit 194 and/or the reamer 190 may include a combination of shearing cutting elements 140 and gouging cutting elements 150, wherein at least some of the gouging cutting elements 150 having selected areas of their outer faces 155 polished, as described herein. Utilizing such a drill bit 194 carrying polished gouging cutting elements 150 and such a reamer 190 carrying polished cutting elements may allow operators to enhance the reduction in torque required to drill and/or ream the wellbore, as well as reduce risk of balling and/or stick-slip and increase the amount of directional control of the drill bit, as previously described.

Although the foregoing description and example embodiments contain many specifics, these are not to be construed as limiting the scope of the present disclosure, but merely as providing certain example embodiments. Similarly, other embodiments of the disclosure may be devised which are within the scope of the present disclosure. For example, features described herein with reference to one embodiment may also be combined with features of other embodiments described herein. The scope of the disclosure is, therefore, indicated and limited only by the appended claims and legal equivalents thereof, rather than by the foregoing description. All additions, deletions, and modifications to the devices, apparatuses, systems and methods, as disclosed herein, which fall within the meaning and scope of the claims, are encompassed by the present disclosure.

What is claimed is:

1. An earth-boring tool, comprising:

a body;

at least one cutting element carried by the body, the at least one cutting element comprising:

a volume of superabrasive material disposed on a substrate, the volume of superabrasive material having an exposed outer surface, the exposed outer surface comprising:

a curved crest positioned generally at an apex of the exposed outer surface;

a first generally planar flank positioned on a first side of the crest;

a second generally planar flank positioned opposite the first side of the crest;

a first generally rounded portion located between the crest, the first generally planar flank, and the second generally planar flank; and a second rounded portion located between the crest, the first generally planar flank, and the second generally planar flank opposite the first generally rounded portion; and wherein the at least one cutting element is located and oriented on the body so as to remove subterranean earth formation material by compressing and fracturing or plastically deforming the formation material with at least a portion of the exposed outer surface of the volume of superabrasive material during use of the earth-boring tool in an earth-boring operation, the exposed outer surface of the volume of superabrasive material comprising a first area having a first average surface finish roughness and a second area having a second average surface finish roughness greater the first average surface finish roughness, wherein the first area comprises at least one of: the curved crest, at least a portion of the first generally planar flank, at least a portion of the second generally planar flank, at least a portion of the first generally rounded portion, or at least a portion of the second rounded portion, and wherein the second area comprises at least one of: at least a portion of the first generally planar flank, at least a portion of the second generally planar flank, at least a portion of the first generally rounded portion, or at least a portion of the second rounded portion.

2. The earth-boring tool of claim 1, wherein the earth-boring tool is a fixed-cutter drill bit.

3. The earth-boring tool of claim 2, wherein the body includes at least one blade having a profile including an inner cone region, a nose region, and a shoulder region, and the at least one cutting element is attached to the blade in one or more of the nose region and the shoulder region of the profile of the blade.

4. The earth-boring tool of claim 2, wherein the body includes at least one blade, the earth-boring tool further comprising at least one second cutting element attached to the at least one blade, and wherein the at least one cutting element is attached to the at least one blade at a location on the at least one blade rotationally trailing the at least one second cutting element, the at least one second cutting element configured to remove subterranean earth formation material by shearing the formation material from uncut formation material.

5. The earth-boring tool of claim 2, wherein the body includes a first blade and a second blade, the second blade located adjacent the first blade in a rotationally leading position on the body, the at least one cutting element attached to the first blade, a plurality of cutting elements attached to the second blade, the plurality of cutting elements configured to remove subterranean earth formation material by shearing the formation material from uncut formation material.

6. The earth-boring tool of claim 1, wherein the earth-boring tool is a reamer, the body having a blade mounted thereon, the at least one cutting element attached to the blade.

7. The earth-boring tool of claim 6, wherein the reamer includes at least one second cutting element attached to the blade, the at least one cutting element positioned at a location of the blade rotationally trailing the at least one second cutting element, the at least one second cutting element configured to remove subterranean earth formation material by shearing the formation material from uncut formation material.

8. The earth-boring tool of claim 6, wherein the body has a second blade mounted thereon, the second blade located adjacent the first blade in a rotationally leading position, a plurality of cutting elements attached to the second blade, the plurality of cutting elements configured to remove subterranean earth formation material by shearing the formation material from uncut formation material.

9. The earth-boring tool of claim 1, wherein the body includes a face and a blade located on the face, the blade having an outer surface, the at least one cutting element is attached to the outer surface of the blade, the first area of the exposed outer surface of the at least one cutting element is positioned remote from the face of the body, the first area configured to prevent formation cuttings from becoming trapped between the outer surface of the blade and an exposed surface of uncut subterranean earth formation.

10. The earth-boring tool of claim 1, wherein:

the at least one cutting element comprises a first plurality of cutting elements; and the body comprises:

a first plurality of blades carrying the first plurality of cutting elements; and a second plurality of blades carrying a second plurality of cutting elements, each of the second plurality of cutting elements configured to remove subterranean earth formation material by shearing the formation material from uncut formation material.

11. The earth-boring tool of claim 10, wherein each of the first plurality of cutting elements is located at a substantially rotationally trailing position relative to an associated cutting element of the second plurality of cutting elements.

12. The earth-boring tool of claim 1, wherein the body includes a blade having a rotationally leading edge, the at least one cutting element is mounted on the blade proximate the rotationally leading edge, a second cutting element is mounted on the blade proximate the rotationally leading edge of the blade and proximate the at least one cutting element, the second cutting element configured to remove subterranean earth formation material by shearing the formation material from uncut formation material.

13. The earth-boring tool of claim 12, wherein the first area of the exposed outer surface of the volume of superabrasive material is located on a portion of the exposed outer surface proximate the second cutting element.

14. A method of forming an earth-boring tool, comprising:

obtaining a first cutting element comprising a volume of superabrasive material disposed on a substrate, the volume of superabrasive material having an exposed outer surface, the exposed outer surface comprising:

a curved crest positioned generally at an apex of the exposed outer surface;

a first generally planar flank positioned on a first side of the crest;

a second generally planar flank positioned opposite the first side of the crest;

a first generally rounded portion located between the crest, the first generally planar flank, and the second generally planar flank; and a second rounded portion located between the crest, the first generally planar flank, and the second generally planar flank opposite the first generally rounded portion; and wherein the first cutting element is configured to be located and oriented on the earth-boring tool so as to remove subterranean earth formation material by compressing and fracturing or plastically deforming the formation material with at least a portion of the exposed outer surface of the volume of superabrasive material during use of the earth-boring tool in an earth-boring operation, the exposed outer surface of the volume of superabrasive material comprising a first area having a first average surface finish roughness and a second area having a second average surface finish roughness greater than the first average surface finish roughness;

attaching the first cutting element to a face of the earth-boring tool; and attaching a second cutting element to the face of the earth-boring tool at a location adjacent the first cutting element, the second cutting element configured to remove subterranean earth formation material by shearing the formation material from uncut formation material.

15. The method of claim 14, wherein the earth-boring tool includes a blade positioned on the face, and attaching the first cutting element to the face of the earth-boring tool comprises attaching the cutting element to the blade such that the first area of the exposed outer surface of the volume of superabrasive material is located remote from the face of the earth-boring tool.

16. A cutting element for an earth-boring tool, comprising:

a substrate; and a volume of superabrasive material disposed on a substrate, the volume of superabrasive material having an exposed outer surface, the exposed outer surface comprising:

a curved crest positioned generally at an apex of the exposed outer surface;

a first generally planar flank positioned on a first side of the crest;

a second generally planar flank positioned opposite the first side of the crest;

a first generally rounded portion located between the crest, the first generally planar flank, and the second generally planar flank; and a second rounded portion located between the crest, the first generally planar flank, and the second generally planar flank opposite the first generally rounded portion; and wherein the cutting element is configured to be located and oriented on the earth-boring tool so as to remove subterranean earth formation material by compressing and fracturing or plastically deforming the formation material with at least a portion of the exposed outer surface of the volume of superabrasive material during use of the earth-boring tool in an earth-boring operation, the exposed outer surface of the volume of superabrasive material comprising a first area having a first average surface finish roughness and a second area having a second average surface finish roughness greater than the first average surface finish roughness.

17. The cutting element of claim 16, wherein the first area comprises the first generally planar flank and the second area comprises the second generally planar flank.

18. The cutting element of claim 16, wherein the first average surface finish roughness is less than about 254 nanometers root mean square.

19. The cutting element of claim 18, wherein the second average surface finish roughness is greater than about 254 nanometers root mean square.

20. The cutting element of claim 16, wherein the first area comprises the apex of the exposed outer surface of the volume of superabrasive material.

* * * * *